United States Patent [19]

Lesquir et al.

[11] Patent Number: 4,968,075

[45] Date of Patent: Nov. 6, 1990

[54] TAMPER-PROOF TAG

[75] Inventors: Dominique Lesquir, Rockland; Bernard Landry, St. Foy, both of Canada

[73] Assignee: IPL, Inc., St. Damien Bellechasse, Canada

[21] Appl. No.: 527,771

[22] Filed: May 24, 1990

Related U.S. Application Data

[63] Continuation-in-part of Ser. No. 434,215, Nov. 13, 1989, Pat. No. 4,940,268.

[51] Int. Cl.[5] ..... B65D 33/34

[52] U.S. Cl. ..... 292/321

[58] Field of Search ..... 292/316, 318, 319, 320, 292/321, 322, 323, 325; 24/16 PB, 305 R

[56] References Cited

U.S. PATENT DOCUMENTS

| | | | |
|---|---|---|---|
| 1,866,461 | 7/1932 | Goschnick | 292/319 |
| 3,157,421 | 11/1964 | Nierhaus | 292/319 X |
| 4,240,183 | 12/1980 | Sumimoto et al. | 292/319 X |
| 4,506,415 | 3/1985 | Swift | 292/318 X |
| 4,697,833 | 10/1987 | Swift | 292/318 |

*Primary Examiner*—Richard E. Moore

*Attorney, Agent, or Firm*—James R. Longacre; Michael L. Keller

[57] ABSTRACT

A tamper-proof tag, made of a unitary body formed of injection molded plastic material, comprises a fastener flexibly connected to a strap, the latter being foldable into a ring with one end engageable into a catch defined at the other end of the strap. The fastener is so configured that, once received in the catch, it may be forcingly engaged into an opening defined in the strap and extending in the catch of the engaged strap. Once engaged, the fastener cannot be removed without damaging the tag.

10 Claims, 5 Drawing Sheets

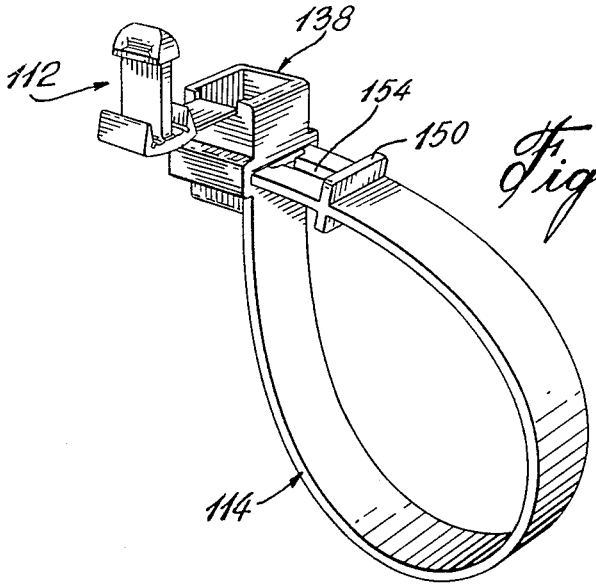
Fig. 10
Fig. 12
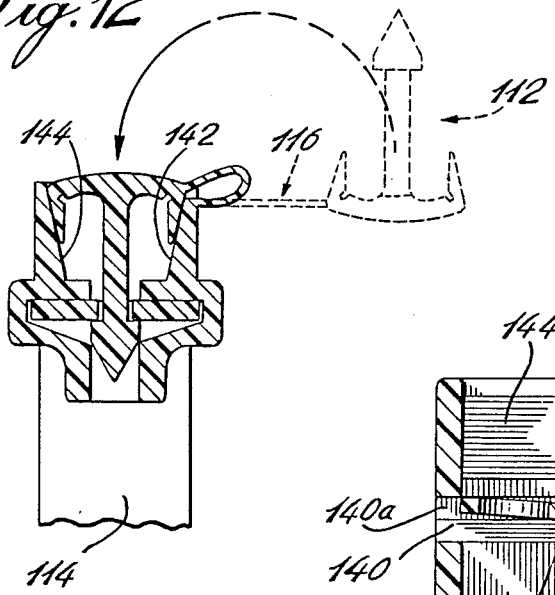
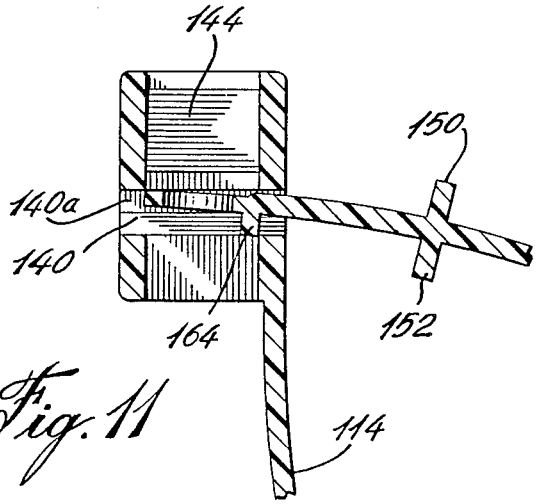
Fig. 11

TAMPER-PROOF TAG

RELATED APPLICATION

This is a continuation-in-part of U.S. patent application Ser. No. 07/434,215 filed Nov. 13, 1989 now U.S. Pat. No. 4,940,268, issued July 10, 1990.

FIELD OF THE INVENTION

The present invention relates to a tamper-proof tag and, more particularly, to a type of tag which will be damaged if tampered with.

OBJECTS AND STATEMENT OF THE INVENTION

It is an object of the present invention to provide a tag which cannot be opened or falsified without thereafter displaying an apparent marking.

The present invention relates to a tamper-proof tag which consists of a unitary body formed of molded plastic material, which comprises:

a fastener defining a T-shaped body having a stem portion and a head portion; the head portion has, at each opposite end thereof, a depending flexible arm; the stem portion displays an enlarged extremity with a cross-section greater than that of the stem portion;

a flexible strap consisting of an elongate body displaying opening means having a cross-section smaller than that of the enlarged extremity of the stem portion, but slightly greater than that of the remaining stem portion thereof; the strap further includes, at one end thereof, a catch for receiving therein the elongate body of the strap and the fastener; the catch displays a slot having a cross-section slightly greater than that of the elongate body when folded to define a ring, and further defines an entrance for receiving therein the fastener whereby the stem portion may be engaged with the folded elongate body by forcingly introducing the enlarged extremity in the opening means; the enlarged extremity is shaped so that, once introduced in the hole, it cannot be removed therefrom; and flexible means connecting the fastener to the catch.

In one form of the invention, the opening means consist of a single slot adjacent an end opposite to said one end of the strap, means being provided to position exactly the slot in the catch in alignment with the enlarged extremity of the stem portion of the fastener.

In another form of the invention, means are provided on the elongate body of the strap to ensure that entry of the strap end in the catch slot may be carried out from one side of the catch only.

In one preferred form of the invention, the arms are made to flex by having reduced areas in the joining sections of the arms with the head portion of the fastener.

In another embodiment, the catch defines a housing which entirely encloses the arms of the fastener so that the connected parts of the tag cannot be reached.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

FIG. 10 is a perspective view of the strap folded prior to engagement by the fastener;

FIG. 11 is an enlarged cross-sectional view of the catch and strap extremity such as shown in FIG. 10; and FIG. 12 is an enlarged cross-sectional view showing the fastener with the catch of the strap.

DESCRIPTION OF PREFERRED EMBODIMENTS

Figure 1:
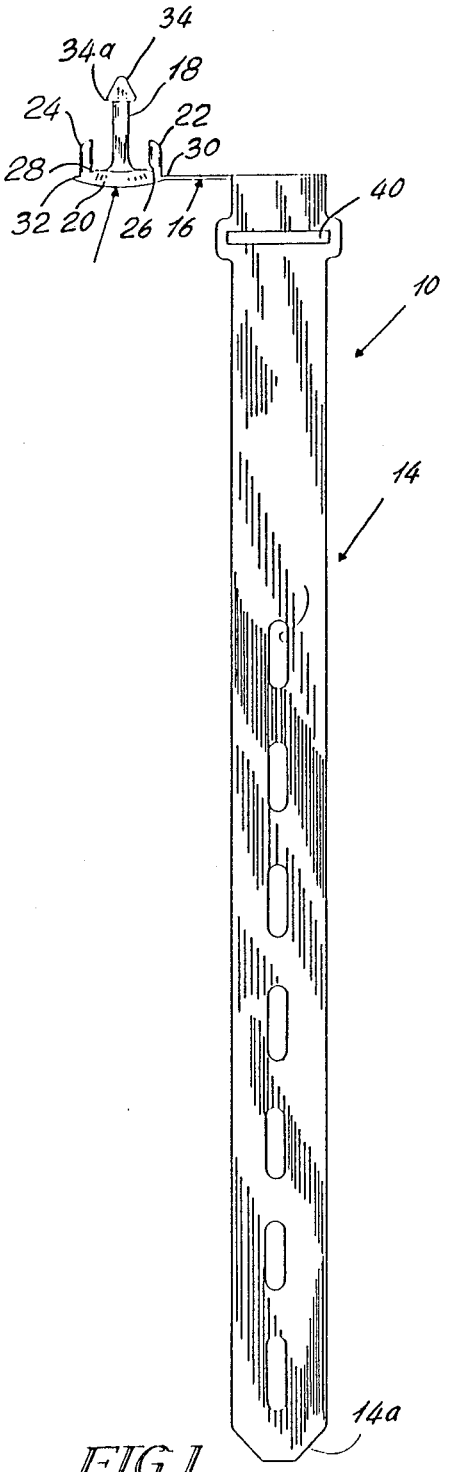
FIG. 1 is a front elevational view of the tag made in accordance with the present invention.
Figure 2:
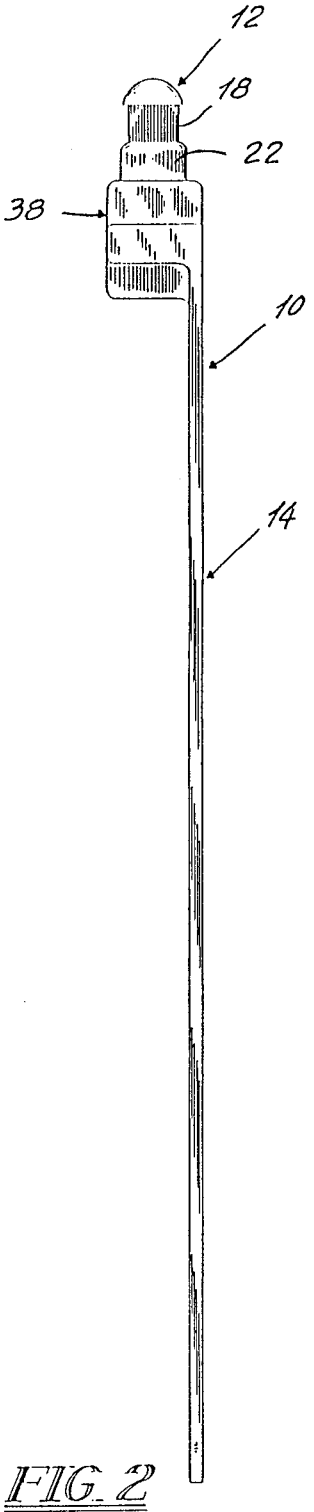
FIG. 2 is a side elevational view of the tag.

Referring to FIGS. 1 and 2, there is shown a tamper-proof tag, generally denoted at 10, which consists of a unitary body formed of injection molded plastic material, such as high-density polyethylene; it comprises three parts: a fastener 12, a strap 14 and a flexible connecting band 16.

The fastener 12 defines a T-shaped body having a stem portion 18 and a head portion 20, the latter displaying, at opposite ends thereof, depending arms 22 and 24 which are flexible relative to the head 20 due to the reduced areas 26 and 28 at their joining. The head portion 20 displays a curved outer surface with opposite flanges 30 and 32. The stem portion 18 has an enlarged extremity 34 in the shape of an arrow head, the cross-section of which is larger than that of the remaining stem portion 18.

The strap 14 consists of an elongate body displaying a series of aligned elongated holes 36, the width of which is smaller than that of the base **34*a* of the arrow head 34, but slightly larger than the cross-section of the remaining stem portion 18. The upper part of the strap terminates in the form of a catch, generally denoted 38, which is shaped as a housing which is traversed by a flat rectangular slot 40. The housing is defined by a pair of opposite inwardly tapering inner side walls 42 and 44 contiguous with horizontal short walls 46 and 48, the latter contiguous with respective opposite vertical walls 50 and 52 which define, with the bottom wall 54, a cavity 56**.

Figure 4:
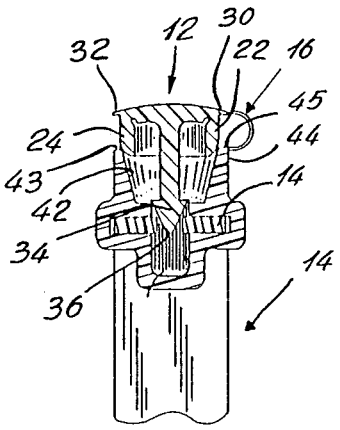
Figure 5:
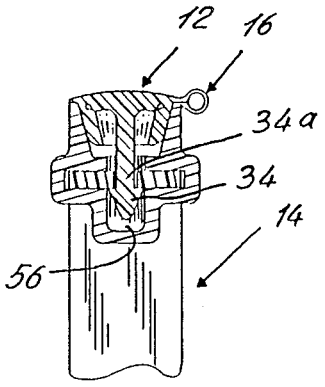
Figure 6:
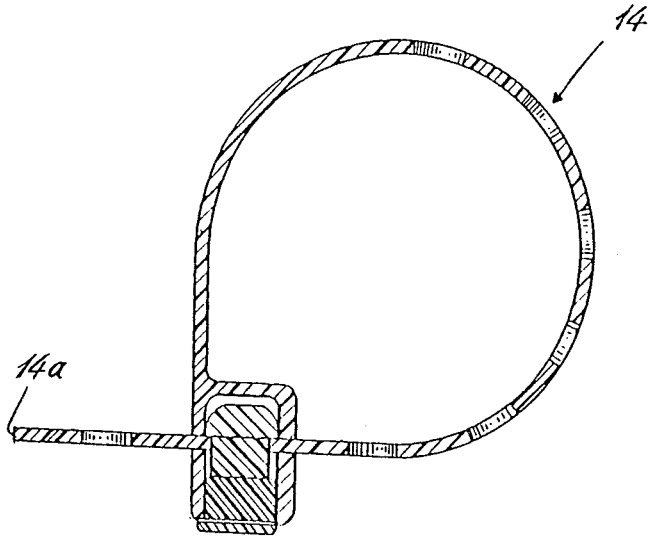
FIG. 6 is a cross-sectional view of the tag in the engaged position.

Referring to FIGS. 4, 5 and 6, the engagement of the tag is accomplished by folding strap 14 into a ring and inserting its free end **14*a* through the slot 40; one of the holes 36 is located in alignment over the cavity 56 (see FIG. 4). The fastener 12 is then folded into the housing with the arms 22 and 24 slidingly contacting the tapering walls 44 and 42, respectively. The enlarged extremity 34 of the fastener is forced through the small holes 36 of the strap located in the strap and is then received in the cavity 56 (see FIG. 5). The downward movement of the fastener is stopped by the contacting of the flanges 30 and 32 with the upper edges 43 and 45** of the catch.

In the engaged position, the shoulder areas **34*a*** of the arrow-head are in abutment with the undersurface of the strap adjacent the hole thereby preventing removal of the fastener from the catch.

To further ensure the tamper-proof feature of the present invention, the flanges 30 and 32 cover the upper edges 43 and 45 (see FIG. 5) thereby preventing access to the connected parts inside the housing.

Figure 8:
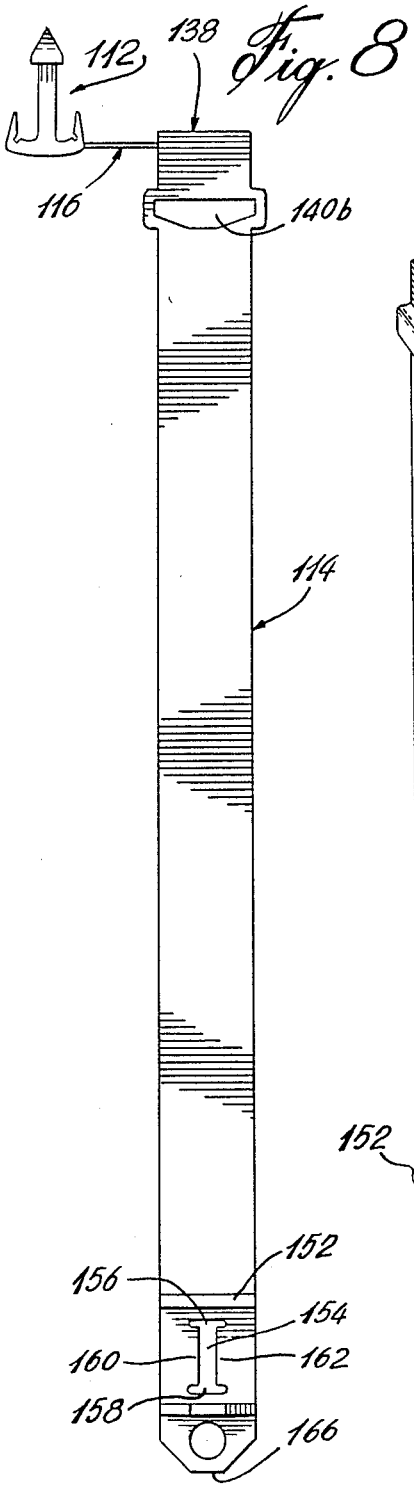
FIG. 8 is a front elevational view thereof.
Figure 7:
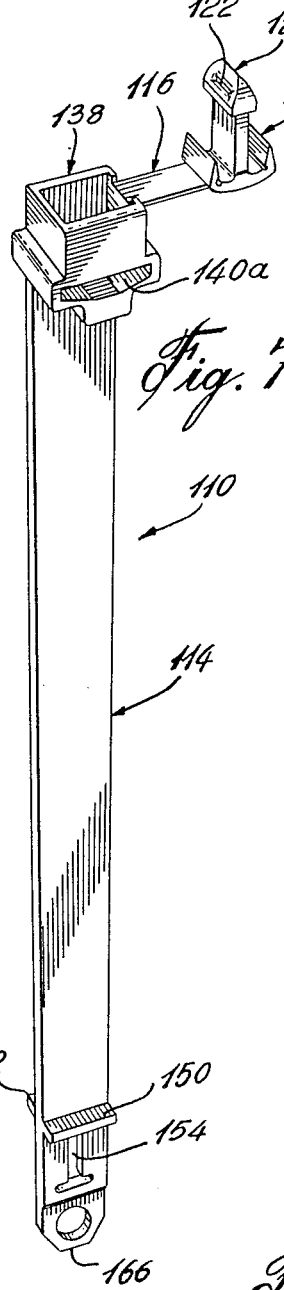
FIG. 7 is a perspective view of another embodiment of a tag made in accordance with the present invention.
Figure 9:
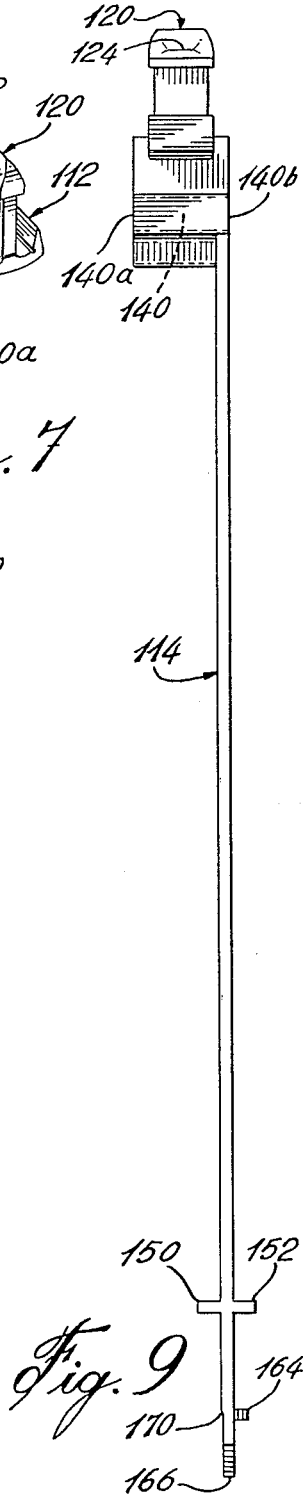
FIG. 9 is a side elevational view thereof.

Referring to FIGS. 7, 8 and 9, there is shown another embodiment of a tamper-proof tag, generally denoted 110, made in accordance with the present invention. It consists of a unitary body formed of injection molded plastic material, such as high-density polyethylene, which is formed of three parts; a fastener 112, a strap 114 and a flexible connecting band 116.

The fastener 112 defines a T-shaped body which is identical in construction to that fastener 112 of FIG. 1, with one exception however: the arrow head end 120 displays indented areas 122 and 124 on its opposite side faces; this reduces the possibility of damaging the arrow head end as it is introduced in engagement as described below.

Figure 3:
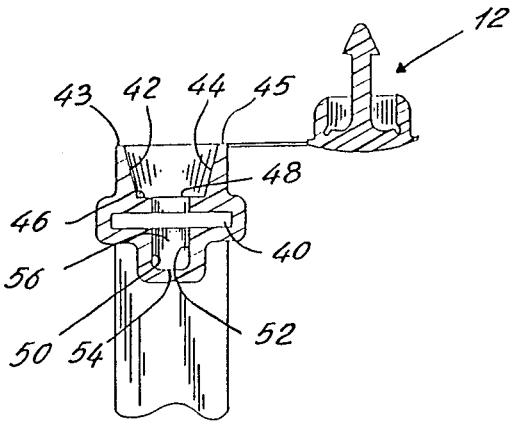
FIGS. 3, 4 and 5 are cross-sectional views showing three successive steps in the engagement of the fastener into the catch of the strap.

The strap 114 consists of an elongate body displaying at one end thereof a catch, generally denoted 138, which is traversed by a horizontal slot 140. At one end 140*a*, the slot has a rectangular cross-section while, at an opposite end 140*b*, it has a different configuration (see FIG. 7). The housing includes a pair of opposite inner side walls 142 and 144 (see FIG. 11) inwardly tapering in a manner similar to that shown in FIG. 3.

The extremity of the strap opposite to that of the catch displays a pair of rectangular stopper projections 150 and 152 extending perpendicularly to the planar surfaces of the strap. The extremity also displays an I-shaped opening 154 which has narrow opposite slots 156, 158, thus rendering facing walls 160, 162 somewhat flexible.

One face of strap 114 includes a further projection 164 having a configuration corresponding to that of opening 140*b* of the catch slot. Extremity 166 of the strap, if folded clockwise in FIG. 9 to penetrate into the slot entrance 140*a*, will not enter due to the latter's rectangular cross-sectional configuration which does not match that of the strap at the level of projection 164. Therefore, extremity 166 can only be inserted in slot 140*b* by folding the strap 114 counterclockwise (see FIG. 10).

The folding operation illustrated requires the operator to use both hands. However, it is sometimes desired for the operator to free one hand to do other manual operation; but, the resiliency of the plastic body 114 would normally cause the extremity 166 to retract from the catch 138. As illustrated in FIG. 9, the lower end 166 of the strap has a recessed line 170 thus providing a reduced cross-section at that extremity of the strap. Referring to FIG. 11, this reduced cross-section allows the extremity of the strap to adopt a slight inclination in the slot 140 and to have projection 164 abut the lower side of the slot.

Although the invention has been described above with respect with one specific form, it will be evident to the person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A tamper-proof tag consisting of a unitary body formed of molded plastic material and comprising:

(i) a fastener defining a T-shaped body having a stem portion and a head portion; said head portion having, at each opposite end thereof, a depending flexible arm; said stem portion displaying an enlarged extremity having a cross-section greater than that of said stem portion;

(ii) a flexible strap including an elongate body displaying opening means having a cross-section smaller than that of said enlarged extremity of said fastener, but slightly greater than that of said stem portion thereof; said strap further including, at one end thereof, a catch for receiving therethrough said elongate body and for receiving therein said fastener; said catch defining a slot having a cross-section slightly greater than that of said elongate body, and an entrance for receiving therein said fastener whereby said stem portion of said fastener is engaged with said folded elongate body by forcingly introducing said enlarged extremity of said stem portion through said opening means; said enlarged extremity being shaped so that, once introduced in said opening means, it cannot be removed therefrom; and (iii) flexible means connecting said fastener to said catch.

2. A tamper-proof tag as defined in claim 1, wherein said opening means consists of a slot in said elongate body at an end opposite to said one end of said catch.

3. A tamper-proof tag as defined in claim 2, wherein said opposite end of said elongate body includes stopper means adapted to contact said catch extremity for limiting entry of said elongate body in said catch.

4. A tamper-proof tag as defined in claim 2, wherein said opposite end of said elongate body includes a projection on one face thereof thereby providing a cross-sectional configuration corresponding substantially to the cross-section of said slot of said catch and limit entry of said opposite end of said strap in said catch to one side only.

5. A tamper-proof tag as defined in claim 2, wherein said elongate slot in said elongate body is I-shaped.

6. A tamper-proof tag as defined in claim 2, wherein each said arm is made to flex by having reduced areas in the region where said arm is connected to said head portion.

7. A tamper-proof tag as defined in claim 6, wherein said entrance of said catch includes opposite side walls inwardly and centrally tapering whereby said arms flex inwardly as they are introduced and contactingly engage said sidewalls.

8. A tamper-proof tag as defined in claim 2, wherein said catch defines a housing enclosing said arms and said enlarged extremity when in engagement in said catch.

9. A tamper-proof tag as defined in claim 8, wherein said head portion of said fastener covers the entrance of said catch to fully close said housing.

10. A tamper-proof tag as defined in claim 9, wherein said head portion has a flange on opposite sides thereof for resting over corresponding upper edges of said catch when said fastener is received in said catch.

* * * * *